US006425734B2

(12) United States Patent
Marx

(10) Patent No.: US 6,425,734 B2
(45) Date of Patent: Jul. 30, 2002

(54) FEED PUMP

(75) Inventor: Peter Marx, Wasbüttel (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/839,279

(22) Filed: Apr. 20, 2001

(30) Foreign Application Priority Data

Apr. 20, 2000 (DE) ..... 100 19 911

(51) Int. Cl.[7] ..... F04D 5/00
(52) U.S. Cl. ..... 415/55.1
(58) Field of Search ..... 415/55.1–55.6, 415/55.7

(56) References Cited

U.S. PATENT DOCUMENTS

| | | | | |
|---|---|---|---|---|
| 4,678,395 A | 7/1987 | Schweinfurter | ..... | 415/53 |
| 5,110,265 A | 5/1992 | Kato et al. | ..... | 417/279 |
| 5,596,970 A | 1/1997 | Schoenberg | ..... | 123/497 |
| 6,152,688 A | 11/2000 | Staab et al. | ..... | 415/55.5 |

FOREIGN PATENT DOCUMENTS

| | | | | |
|---|---|---|---|---|
| DE | 2 112 762 | 10/1972 | ..... | F04D/5/00 |
| DE | 33 03 460 | 8/1984 | ..... | F04D/5/00 |
| DE | 41 02 323 | 7/1992 | ..... | F04D/5/00 |
| DE | 197 25 249 | 12/1998 | ..... | F04D/5/00 |
| EP | 0 097 924 | 6/1983 | ..... | F01D/1/02 |
| EP | 0 118 027 | 2/1984 | ..... | F04D/5/00 |
| JP | 61190191 A * | 2/1985 | ..... | 415/55.6 |

* cited by examiner

*Primary Examiner*—F. Daniel Lopez
*Assistant Examiner*—Dwayne White
(74) *Attorney, Agent, or Firm*—Cohen, Pontani, Lieberman & Pavane

(57) ABSTRACT

A feed pump includes two feed chambers one surrounding the other and arranged at different axial levels from an electric motor driving the feed pump. A radially inner feed chamber of the two feed chambers is arranged for filling a baffle of a fuel tank of a motor vehicle. The radially outer feed chamber is arranged for suctioning in fuel from the baffle. The feed pump is of particularly compact design and the radially inner feed chamber is arranged at a low level in the baffle.

12 Claims, 1 Drawing Sheet

FEED PUMP

BACKGROUND OF THE INVENTION

1. Field of the Invention

The invention relates to a feed pump for arrangement in a baffle of a motor vehicle fuel tank, the feed pump having a driven impeller rotatably arranged in a pump casing with a plurality of rings or guide blades delimiting blade chambers, the rings concentrically surrounding one another, and part-annular channels arranged in the pump casing opposite the rings of blade chambers and extending from an inlet channel to an outlet channel.

2. Description of the Related Art

Feed pumps produced in the form of peripheral or side-channel pumps are known from practice. The known feed pumps may be of multistage design. For example, the feed pump may be designed for feeding fuel from a fuel tank to a baffle and simultaneously feeding fuel from the baffle to an internal combustion engine of the motor vehicle. The impeller of the known feed pump is typically fastened on a shaft of an electric motor. Part annular chambers are arranged in a pump casing of the feed pump corresponding to rings of guide blades which delimit blade chambers in the impeller. Between the part-annular channels, the pump casing is located with particularly slight clearance opposite the impeller to form a sealing gap. This configuration allows a plurality of pumping stages to be arranged on a single impeller. Each of the pumping stages may be designed freely for the respective application.

A problem of the known feed pump is that a pressure difference between the part-annular channels one surrounding the other leads to an overflow of the fed liquid and consequently to high axial forces on the impeller. The overflow therefore reduces the efficiency of the feed pump.

SUMMARY OF THE INVENTION

It is an object of the present invention to provide a feed pump having part-annular channels one surrounding the other and corresponding to rings of guide blades on an impeller such that liquid to be fed is prevented from flowing between the part-annular channels.

The object of the present invention is met by a feed pump with an impeller having an end face with a plurality of levels in the axial direction of the driven shaft on which the impeller is mounted so that at least two rings of guide blades are arranged at two different levels along the axial direction.

This configuration allows the sealing gap to be made particularly long thereby providing particularly high resistance to an overflow of the liquid to be fed. In comparison with the known feed pump with a sealing gap having the same width, the feed pump according to the present invention allows only a particularly small amount of liquid to flow from one part-annular channel to another part-annular channel. Axial forces acting on the impeller are thereby kept particularly low. The feed pump according to the present invention consequently has a particularly high efficiency. Another advantage of this configuration is that the two levels arranged in the impeller require that the impeller to be inserted in the casing in the correct position. This ensures that impeller is rotated in the intended direction of rotation by the shaft of the electric motor.

According to an embodiment of the present invention, the sealing gap may be kept particularly small if an axial play of the impeller is provided. Furthermore, the impeller may have a continuous collar for separating the different levels and the pump casing may have a step corresponding to the collar.

According to another embodiment of the present invention, the impeller and the pump casing may be manufactured particularly cost-effectively when the collar is designed cylindrically.

The feed pump requires a particularly small axial construction space when the inlet channel or the outlet channel of the radially inner part-annular channel is led radially outward through a web in the pump casing arranged between the outlet channel and the inlet channel of the radially outer part-annular channel.

A radially inner ring of guide blades is arranged on a first level and a radially outer ring of guide blades is arranged on a second level, wherein a plane of the first level at a greater distance from an electric motor driving the impeller than the plane of the second level. This configuration contributes facilitates further reducing the axial dimensions of the feed pump. When the feed pump is mounted with the electric motor, the radially outer part-annular channel may be arranged at least partially radially outside the electric motor. When the feed pump is mounted in the baffle of a fuel tank, the radially inner ring of blade chambers may thereby be arranged at a particularly low level thereby avoiding a high suction head. A high suction head leads to the formation of gas bubbles and therefore to a sharp drop in the efficiency of the feed pump, particularly where the medium to be fed is hot fuel. Locating the radially inner ring of blade chambers at a particularly low level facilitates a high efficiency in the feed pump according to the present invention.

According to another embodiment of the invention, the blade chambers of the radially inner ring of guide blades have large diameter and are designed for feeding as large a volume flow as possible. In this embodiment, the impeller is thicker in the region of the radially inner ring of guide blades than in the region of the radially outer ring of guide blades.

A feed pump having high feed pressure provided when fuel is intended to be fed to the internal combustion engine of a motor vehicle and with as large a volume flow as possible to be fed into the baffle may be designed with a particularly simple design when the blade chambers of the radially inner ring of guide blades have approximately double the diameter of the blade chambers of the radially outer ring of guide blades.

According to another embodiment of the present invention, an axial feed of the fuel through the feed pump may be achieved at particularly low outlay in terms of construction when the impeller has in the radially outer region of its end faces rings of guide blades located opposite one another for forming blade chambers therebetween, wherein the blade chambers on opposite sides of the impeller are connected to one another.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1:
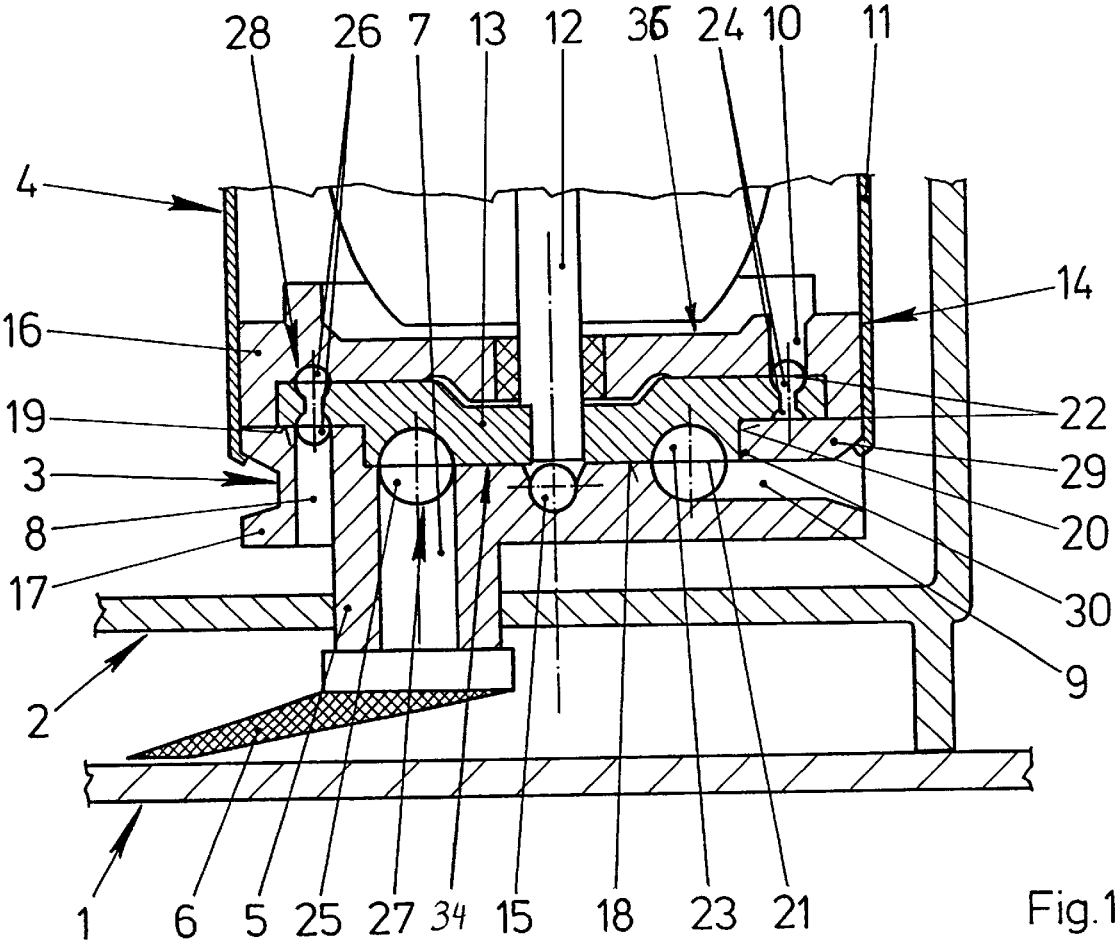
FIG. 1 is a longitudinal sectional view of a feed pump according to the present invention mounted in the baffle of a motor vehicle fuel tank.

FIG. 1 shows a bottom of a fuel tank 1 of a motor vehicle with a baffle 2 supported relative to the bottom of the fuel tank 1. A feed pump 3 is arranged within the baffle 2. The feed pump 3 forms a structural unit with an electric motor 4. A connection piece 5 of the feed pump 3 passes through the bottom of the baffle 2 and a filter 6 resting against the bottom of the fuel tank 1 is attached to the connection piece 5. In the interests of simplicity, the filter 6 is illustrated diagrammatically in FIG. 1. The feed pump 3 has two inlet channels 7, 8, wherein inlet channel 7 is lead through the connection piece 5 to the filter 6 and inlet channel 8 is arranged proximate the bottom of the baffle 2. The feed pump 3 also has two outlet channels 9, 10, wherein outlet channel 9 opens into the baffle 2 and outlet channel 10 opens into a housing 11 of the electric motor 4. An impeller 13 of the feed pump 3 is arranged on a shaft 12 of the electric motor 4 such that the impeller 13 is fixed with respect to rotation relative to the shaft 12. The impeller 13 is located with a slight clearance opposite a stationary pump casing 14 for forming a sealing gap between the impeller 13 and the pump casing 14. The shaft 12 is mounted in the pump casing 14 via a ball 15.

The pump casing 14 includes a lower casing part 17 and an upper casing part 16. The lower casing part 17 has the two inlet channels 7, 8. The impeller 13 has two end faces 34, 36 with two levels 18, 19 arranged on the end face 34 of the impeller 13 and spaced apart axially from one another along the axial direction of the shaft 12. The levels 18, 19 are separated from one another by a continuous collar 20.

The impeller 13 has a radially inner ring of guide blades 21. Two radially outer rings of guide blades 22 are arranged in a radially outer region of the impeller 13 and located opposite one another. The guide blades 21, 22 respectively delimit blade chambers 23, 24 arranged in the impeller 13. The radially inner ring of guide blades 21 is arranged on the level 18 which is further away from the electric motor 4 than the level 19 on which the radially outer rings of guide blades 22 are arranged. Those blade chambers 24 of the radially outer rings of guide blades 22 which are located opposite one another are connected to one another. The pump casing 14 includes part-annular channels 25, 26 respectively arranged in the region of the rings of guide blades 21, 22. The part-annular channels 25, 26 and the blade chambers 23, 24 respectively form feed chambers 27, 28 which extend from one of the inlet channels 7, 8 as far as one of the outlet channels 9, 10. When the impeller 13 rotates, the feed pump 3 feeds fuel out of the fuel tank 1 through the radially inner feed chamber 27 into the baffle 2 and through the radially outer feed chamber 28 out of the baffle 2 through the electric motor 4 to an internal combustion engine, not illustrated, of the motor vehicle.

The outlet channel 9 of the radially inner feed chamber 27 is led radially outward via a web 29. The continuous collar 20 is located with slight clearance opposite a step 30 of the pump casing 14. This region therefore serves as a sealing gap which largely prevents fuel from flowing over between feed chambers 27, 28 having different pressures. To simplify the drawing, the inlet channels, 7, 8 and the outlet channels 9, 10 are arranged opposite one another. The partannular channels 25, 26 may, of course, also extend over a larger angular range.

Figure 2:
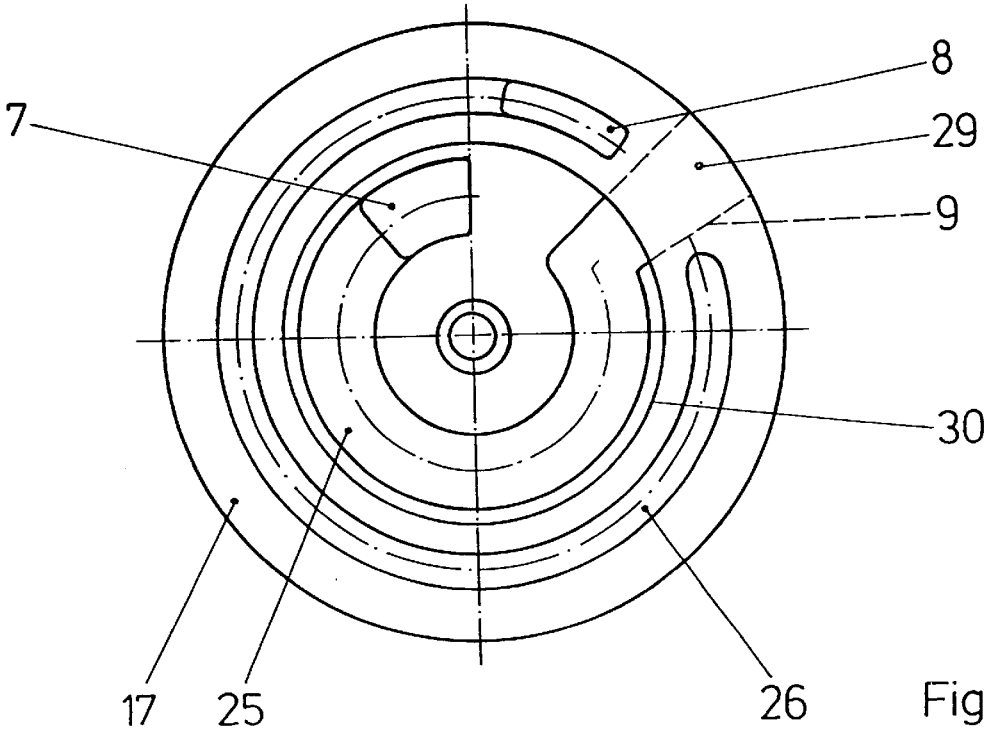
FIG. 2 is a top view of a lower casing part of a pump casing of the feed pump from FIG. 1.

FIG. 2 shows a view of the lower casing part 17 of the pump casing 14, as seen from the impeller 13 from FIG. 1. This drawings shows that the part-annular channels 25, 26 extend over an angular range of approximately 300°.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A feed pump for installation in a baffle of a fuel tank, comprising:

a casing comprising part-annular channels, each part-annular channel extending from an inlet channel to an outlet channel;

an impeller rotatably arranged for rotating in said casing about an axis of rotation, said impeller having at least two rings of guide blades delimiting blade chambers and concentrically arranged thereon and comprising a radially inner ring of guide blades and a radially outer ring of guide blades, each of said at least two rings of guide blades being arranged opposite one of said part-annular channels, said impeller further comprising and end face having a plurality of levels in the axial direction relative to said axis of rotation, wherein said radially inner ring of guide blades and said radially outer ring of guide blades are arranged on two different ones of said plural levels.

2. The feed pump of claim 1, wherein said impeller comprises a continuous collar for separating said two different ones of said plural levels and said casing has a step corresponding to said collar.

3. The feed pump of claim 2, wherein said collar is cylindrical.

4. The feed pump of claim 1, wherein said part-annular channels comprise a radially inner part-annular channel and a radially outer part-annular channel and said casing further comprises a web arranged between the outlet channel and the inlet channel of said radially outer part-annular channel, wherein one of said inlet channel and said outlet channel of said radially inner part-annular channel is lead radially outward via said web.

5. The feed pump of claim 4, further comprising an electric motor driving said impeller, wherein said radially inner ring of guide blades is arranged on a first level of said plural levels and said radially outer ring of guide blades is arranged on a second level of said plural levels, said first level being arranged at a greater distance from said electric motor than said second level.

6. The feed pump of claim 5, wherein a thickness of said impeller is greater in a region of said radially inner ring of guide blades than in a region of said radially outer ring of guide blades.

7. The feed pump of claim 4, wherein said blade chambers comprise a semicircular cross-section having a diameter and said diameter of said blade chambers of said radially inner ring of guide blades is approximately double said diameter of said blade chambers of said radially outer ring of guide blades.

8. The feed pump of claim 4, wherein two of said at least two rings of guide blades are arranged in a radially outer region of said impeller and located on opposing sides of said impeller, said blade chambers of said two of said at least two rings of guide blades being connected to one another.

9. The feed pump of claim 1, further comprising an electric motor driving said impeller, wherein said radially inner ring of guide blades is arranged on a first level of said plural levels and said radially outer ring of guide blades is arranged on a second level of said plural levels, said first level being arranged at a greater distance from said electric motor than said second level.

10. The feed pump of claim 9, wherein a thickness of said impeller is greater in a region of said radially inner ring of guide blades than in a region of said radially outer ring of guide blades.

11. The feed pump of claim 1, wherein said blade chambers comprise a semicircular cross-section having a diameter and said diameter of said blade chambers of said radially inner ring of guide blades is approximately double said diameter of said blade chambers of said radially outer ring of guide blades.

12. The feed pump of claim 1, wherein two of said at least two rings of guide blades are arranged in a radially outer region of said impeller and located on opposing sides of said impeller, said blade chambers of said two of said at least two rings of guide blades being connected to one another.

* * * * *